US011484733B2

(12) United States Patent
Jackson et al.

(10) Patent No.: US 11,484,733 B2
(45) Date of Patent: Nov. 1, 2022

(54) PENDENT FACE MASK

(71) Applicants: Holly Jean Jackson, Palm Springs, CA (US); Sharon M. Gannon, Hemet, CA (US)

(72) Inventors: Holly Jean Jackson, Palm Springs, CA (US); Sharon M. Gannon, Hemet, CA (US)

( * ) Notice: Subject to any disclaimer, the term of this patent is extended or adjusted under 35 U.S.C. 154(b) by 143 days.

(21) Appl. No.: 15/929,743

(22) Filed: May 19, 2020

(65) Prior Publication Data

US 2021/0361984 A1 Nov. 25, 2021

(51) Int. Cl.

| | |
|---|---|
| ***A62B 18/00*** | (2006.01) |
| ***A62B 18/02*** | (2006.01) |
| ***A41D 31/14*** | (2019.01) |
| ***A41D 13/11*** | (2006.01) |
| ***A62B 18/08*** | (2006.01) |

(52) U.S. Cl.

CPC ..... *A62B 18/025* (2013.01); *A41D 13/1161* (2013.01); *A41D 31/14* (2019.02); *A62B 18/084* (2013.01)

(58) Field of Classification Search

CPC .... A62B 18/025; A62B 18/084; A41D 31/14; A41D 13/1161

See application file for complete search history.

(56) References Cited

U.S. PATENT DOCUMENTS

| | | | | |
|---|---|---|---|---|
| 2,281,744 | A * | 5/1942 | Brunner | A41D 13/1161 128/206.13 |
| 5,819,731 | A * | 10/1998 | Dyrud | A41D 13/1146 128/206.13 |
| 2015/0216241 | A1* | 8/2015 | Lee | A41D 13/1192 128/863 |
| 2017/0209720 | A1* | 7/2017 | Mingo | A62B 23/025 |
| 2021/0361002 | A1* | 11/2021 | Allmon | A41D 13/1115 |

* cited by examiner

*Primary Examiner* — Steven O Douglas

(57) ABSTRACT

A pendent face mask is adapted to transition between a facially protective state and a folded state. The pendent face mask includes a foldable, air-permeable facial cover, a plurality of guides, and a suspension system. The suspension system suspends the facial cover in the folded state from a user's neck, and adjustably secures the facial cover in contact with the user's face in the facially protective state. The suspension system includes left and right segments that are drawable to form left and right ear loops.

15 Claims, 8 Drawing Sheets

FIG. 1A
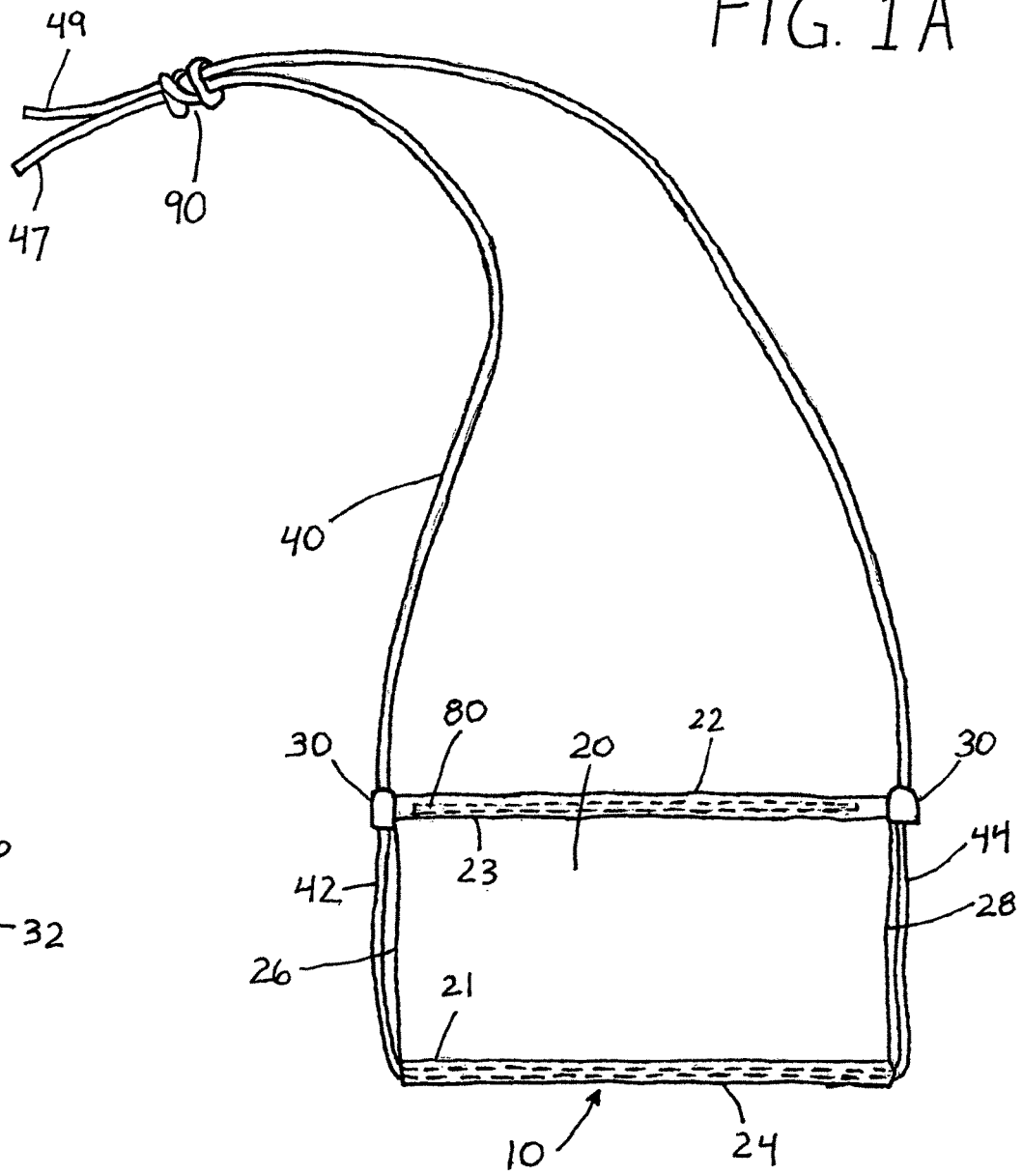
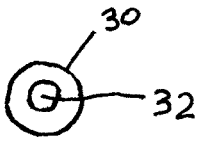
FIG. 1B

FIG. 2C
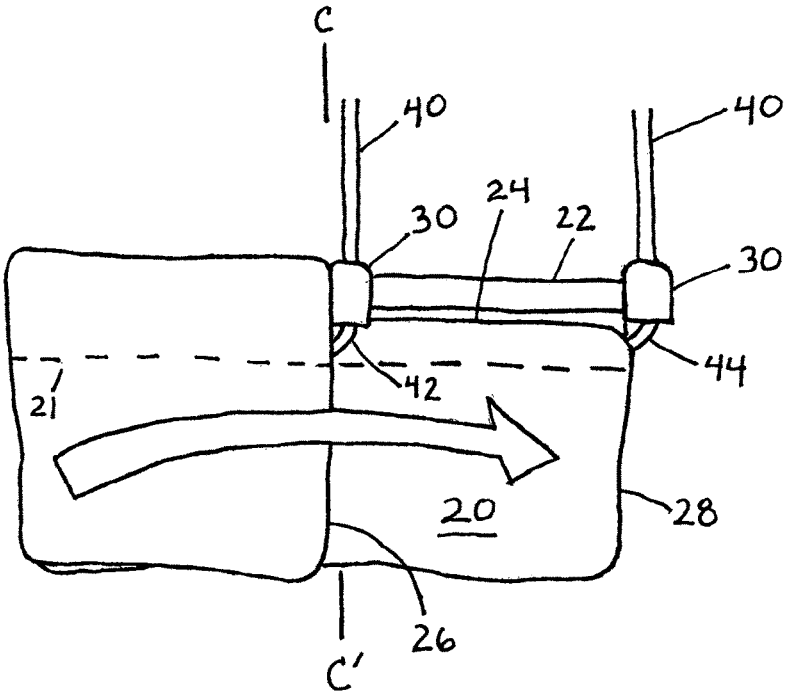
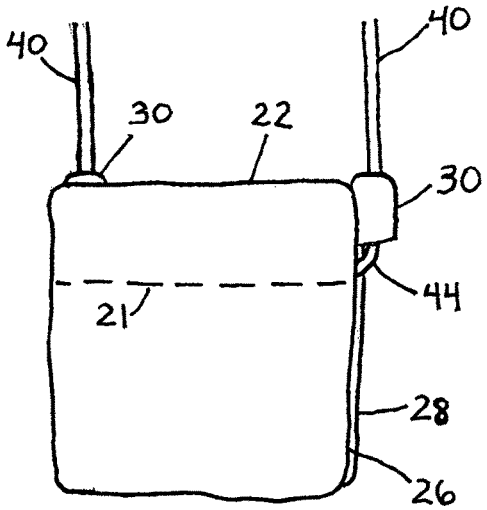
FIG. 2D
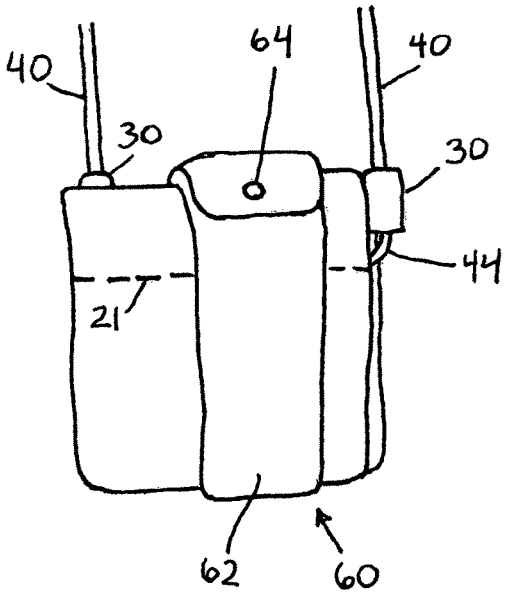
FIG. 2E

PENDENT FACE MASK

BACKGROUND OF THE INVENTION

1) Field of the Invention

The present invention is directed to protective face coverings, and more specifically to protective face masks that are easily worn both when protecting a users face and when not in use.

2) Description of Related Art

Public health concerns, such as the spread of new and dangerous viruses such as the coronavirus, have made facial protective devices, such as masks, increasingly necessary in daily life. The Centers for Disease Control (CDC) recommends wearing masks in public, especially when distances between individuals cannot be sufficiently limited, in order to reduce contagion and transmission of diseases such as COVID-19. In particular, some masks block large and small droplets from coughs and sneezes.

Many types of mask are well-known in the art. For example, U.S. Pat. No. 5,803,075, issued Sep. 8, 1998, to Yavitz, discloses a surgical mask that improves the flow of air to a wearer while limiting the escape of air and vapor from the top of the mask. Yavitz's mask includes an adhesive nosepiece, which opens nasal passages to facilitate air flow to the user. The disclosed mask is secured to a user's face using conventional fasteners, including tie straps that are tied behind the head and neck of the user.

Other masks are disclosed on the Etsy website (http://etsy.com). Masks disclosed and sold therein typically feature left and right ear loops secured to a facial protector, such as an air-permeable cloth (formed, e.g., from a cotton fabric). The ear loops are typically not adjustable. Some masks include an adjustable component that allows for tighter fits over a user's face.

None of the presently known masks, however, are easily and safely stored when not in use; in particular, known masks are not storable in a compact and readily accessible form that is wearable in such compact form. Nor are known masks storable in a protected form that is less subject to contamination, and is less likely to be lost or misplaced.

It would be advantageous to provide a face mask that can be both easily and conveniently worn by a user to protect the user's nose, mouth and face, and stored in an accessible and protected form that is still worn by the user.

SUMMARY OF THE PREFERRED EMBODIMENTS

In accordance with one aspect of the present invention, there is provided a pendent face mask adapted to transition between a facially protective state and a folded state. The pendent face mask includes a facial cover, a plurality of guides, and a suspension system. The facial cover comprises an air-permeable material, and has upper and lower edges and left and right side edges. The cover is foldable about an axis defined between the upper and lower edges, and about a plurality of axes defined between the left and right side edges to form the folded state. Each of the guides has defined therethrough an opening. At least one of the guides is secured to each of the left and right edges of the facial cover. The suspension system slidingly engages through the openings defined through each of the guides, and is adapted to suspend the facial cover in the folded state from a user's neck, and to adjustably secure the facial cover in contact with the user's face in the facially protective state. The suspension system includes left and right segments extending between the lower edge and at least one of the plurality of guides secured respectively to the left and right edges of the facial cover, and are drawable to form left and right ear loops.

According to a more particular embodiment, the inventive pendent face mask further includes a securing device adapted to secure the pendent face mask in the folded state. In still more particular embodiments, the securing device comprises a protective cover. In yet more particular embodiments, the protective cover is a strap or ribbon. In very particular embodiments, the protective cover has an edge which is attached to one of the upper and lower edges of the facial cover.

According to another particular embodiment, the protective cover is a pouch.

In a further more particular embodiment, the facial cover further comprises a foldable nosepiece disposed adjacent the upper edge to support a facially protective state of the pendent face mask.

In still another particular embodiment, the guides are disposed adjacent the upper edge of the facial cover. In yet another particular embodiment, additional guides are disposed adjacent the lower edge of the facial cover.

According to a more specific embodiment, the suspension system is secured adjacent the lower edge of the facial cover.

According to yet another specific embodiment, the suspension system includes a flexible elongated element selected from the group consisting of a cord, a strap, a chain and a wire. In very specific embodiments, the suspension system includes a plurality of flexible elongated elements.

In another particular embodiment, the suspension system includes a tightener adapted to adjustably suspend the facial cover from a user's neck in the folded state and to adjustably secure the facial cover to a user's face in the facially protective state.

According to a particular embodiment, the pendent face mask includes first and second guides secured to each of the left and right sides of the facial cover, with the left and right segments of the suspension system extending between the first and second guides respectively secured to the left and right edges of the facial cover. In this embodiment, the suspension system includes first and second ends, and the pendent face mask further includes a pouch having left and right sides. The pouch is adapted to receive the pendent face mask in the folded state. The first and second ends of the suspension system are secured respectively to the left and right sides of the pouch.

In accordance with another aspect of the present invention, there is provided a method of protecting a face of a human. The method includes the steps of: donning a pendent face mask as described herein; drawing the left and right segments of the suspension system of the pendent face mask to form left and right ear loops; and disposing the left and right ear loops respectively about left and right ears of a human.

According to a more particular embodiment, the suspension system of the pendent face mask donned in the first step includes a tightener adapted to adjustably suspend the facial cover from the human user's neck in the folded state and to adjustably secure the facial cover to the human user's face in the facially protective state, and the method further includes the step of adjustably securing the facial cover to the human user's face using the tightener.

Other features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which FIG. 1A-1B are a plan view of a first embodiment of a pendent face mask according to the invention in an unfolded state (with the facial cover's outer surface in view), and a sectional view of a guide employed in the illustrated embodiment, FIGS. 2A-2E depict a process of folding a pendent face mask of FIG. 1 into a folded state.

In the figures, like numbers are used to denote like elements throughout.

DETAILED DESCRIPTION OF THE PREFERRED EMBODIMENTS

Figure 2A:
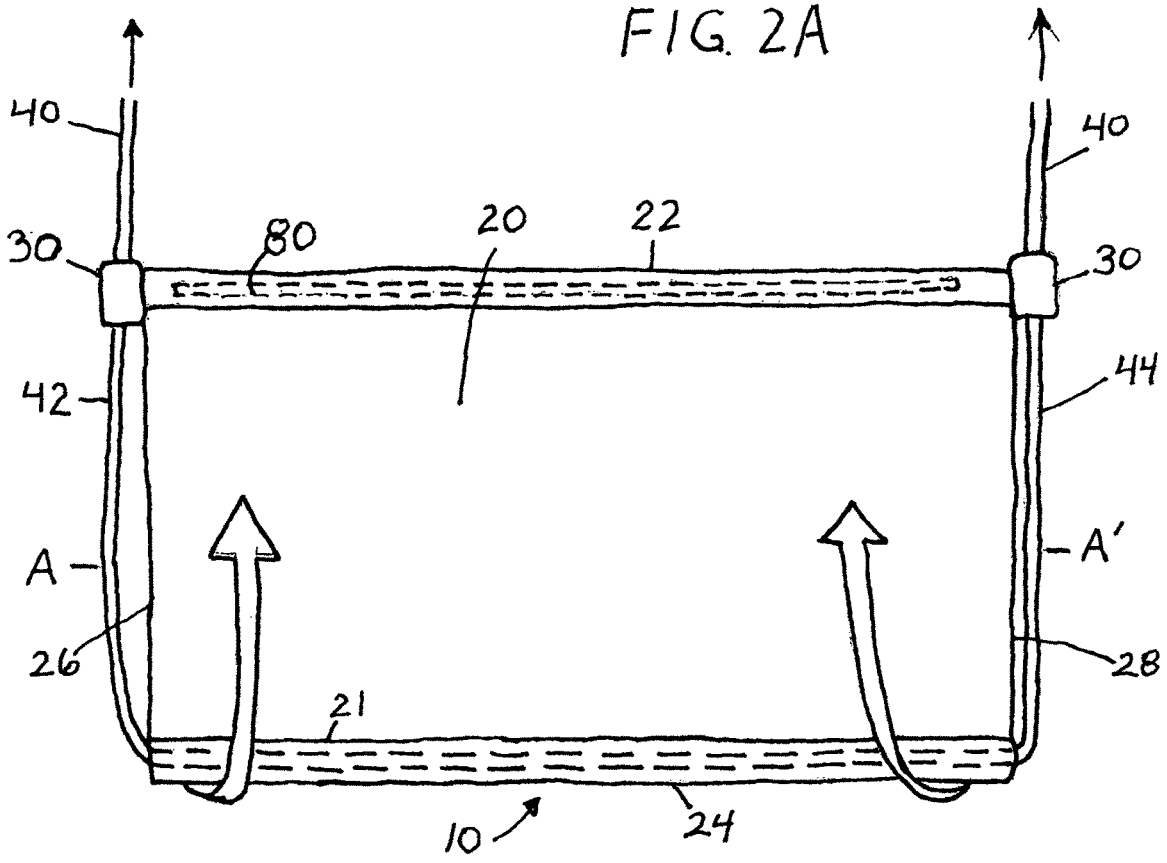

Referring now to the drawings, in FIG. 1, a first embodiment of a pendent face mask 10 according to the invention includes facial cover 20, a plurality of guides 30, and suspension system 40. Facial cover 20 has upper edge 22, lower edge 24, left side edge 26 and right side edge 28. (As used herein, "left" and "right" elements are those viewed by a viewer, rather than a user of the inventive pendent face mask.) As illustrated, facial cover 20 is approximately rectangular, and has a length between 6 and 9 inches, and a width between about 4 and 5 inches. However, in additional embodiments, one or more of the sides of facial cover 20 can be curved. Thus, pendent face masks including facial covers 20 having additional shapes, such as ellipses, are also contemplated as being within the scope of the present invention. Facial cover 20 is constructed from an air-permeable material. In particular embodiments, the air-permeable material is a natural or synthetic fabric, such as cotton fabric, polyester, etc. In additional specific embodiments, the selected air-permeable material is also breathable. In further specific embodiments, the selected air-permeable material also stretch and recovery properties. Materials having such properties are well-known to those skilled in the art. All such air-permeable materials used to form facial cover 20 according to the present invention are capable of being folded both horizontally (i.e., about an axis defined between upper edge 22 and lower edge 24) and vertically (i.e., about a plurality of axes defined between left side edge 26 and right side edge 28).

In further particular embodiments, a plurality of facial covers 20 are provided, forming a layered structure. Multiple such layers can have different properties and functions, including without limitation, moisture absorbance, anti-microbial and/or anti-viral activity, activated charcoal filtration, etc.

A plurality of guides 30 are secured to facial cover 20. At least one guide 30 is secured to each of left side edge 26 and right side edge 28. As illustrated, one guide 30 is secured to each side edge adjacent upper edge 22 of facial cover 20. Guide 30 has defined therethrough guide opening 32, which is adapted to slidingly engage with suspension system 40. Guide 30 can be any structure having an opening through which a flexible elongated element can pass. Such guides can be in the form of a tube, bead, fabric loop, eyelet, hook, or the like. Guides 30 can be attached directly to facial cover 20, for example by stitching, gluing, or using Velcro® strips, or can be attached indirectly via a connecting fabric strip or other connecting element. Additional exemplary guides are formed from two strings, laces, or the like, attached at one end to facial cover 20, which are tied together to form a loop, leaving room to accommodate a flexible elongated element.

Suspension system 40 slidingly engages through openings 32 defined in guides 30. Suspension system 40 preferably is formed from a flexible elongated element, such as a cord, strap, chain, or wire. The flexible elongated element preferably has a length sufficient to allow pendent face mask 10 to hang from a user's neck in its folded state. Varying lengths will afford the user the opportunity to wear pendent face mask 10 as a choker, necklace or pendant. A typical length of, e.g., cord used to form suspension system 40 is about 45 to 60 inches.

In the embodiment of FIG. 1, suspension system 40 is formed from a single cord having free first end 47 and free second end 49. Alternative embodiments of suspension system 40 are formed from a loop formed from a cord, chain or other flexible elongated element (i.e., without free ends). In such alternative embodiments, a flexible elongated element having loose ends can be threaded through guides 30, after which the loose ends are secured to each other to form a closed loop. Additional particular embodiments begin with a closed loop formed from, e.g., a cord, and guides 30 are produced about the closed loop (for example, in the form of fabric loops), which are secured to facial cover 20.

In the embodiment of FIG. 1, suspension system 40 is slidingly engaged with lower edge 24 of facial cover 20 as follows. A strip of fabric used to form facial cover 20 is folded upward along a lower edge thereof and stitched in place along lower seam 21, forming a passage which slidingly accommodates a portion of suspension system 40. The bottom of the folded portion forms lower edge 24 of facial cover 20

Ends 47, 49 of suspension system 40, in particular embodiments, are releasably secured together by tightener 90, which allows the inventive pendent face mask to be adjustably secured to a user's head when worn. Tighter 90 can be, for example, a slip knot (as shown in FIG. 1), a buckle, a clasp, a clip, a plastic tie, a sleeve, or the like. In alternative particular embodiments, ends 47, 49 of suspension system 40 are threaded through guides 30 and secured respectively to left side edge 26 and right side edge 28 of facial cover 20, adjacent lower edge 24 thereof. In these particular embodiments, buckles, clasps, clips, ties, sleeves or the like are useful as tightener 90.

Suspension system 40 includes left and right segments 42 and 44, respectively, which extend between guides 30 and lower edge 24. These segments are drawable outward from left side and right side edges 26, 28, respectively, to form ear loops 50, 52 (see FIG. 4C). These ear loops are placed about a human user's ears, and, when tightener 90 is adjusted as desired, help secure the inventive face mask in place to protect the user's face, nose and mouth. Very particular embodiments further include stoppers, such as knots, sleeves, additional tubes or beads, etc., provided to suspension system 40 between tightener 90 and guides 30, which act to prevent excessive outward draw of segments 42, 44.

More particular embodiments of the inventive face mask include foldable nosepiece 80, secured adjacent upper edge 22 of facial cover 20. Foldable nosepiece 80 is formed, in specific embodiments, from a flexible length of plastic or wire. Flexible nosepiece 80, in particular embodiments, is secured to facial cover 20 by folding an upper edge of a fabric strip used to form facial cover 20 downward over flexible nosepiece 80 and then stitching along upper seam 23. Flexible nosepiece 80 can be removably disposed adjacent upper edge 22 of facial cover 20, or permanently secured in place, for example, by additional stitching or application of an adhesive.

According to particular embodiments, a pendent face mask according to the invention further includes a protective device 60 (see FIG. 2E). The protective device is adapted to secure the pendent face mask in its folded state. An exemplary protective device 60 as shown in FIG. 2E includes ribbon 62, which wraps around a pendent face mask according to the invention and is secured in place with snap 64. Ribbon 62, in certain specific embodiments, is a separate element; in other specific embodiments, ribbon 62 has an end that is secured (e.g., by stitching) to upper edge 22 or lower edge 24 of facial cover 20. Ribbon 62 can also be secured in place using a Velcro® strip, a button and corresponding button hole, a lace, or other fastening devices. Ribbon 62 can be constructed using the same air-permeable fabric used to form facial cover 20, another fabric, or another material such as a leather strap.

In additional particular embodiments, protective device 60 can be a semi-rigid or rigid structure, such as a clamshell or locket, sized to receive a pendent face mask of the invention in its folded state. Such a structure, in particular embodiments, is an element separate from facial cover 20 and not permanently secured thereto.

Figure 2B:
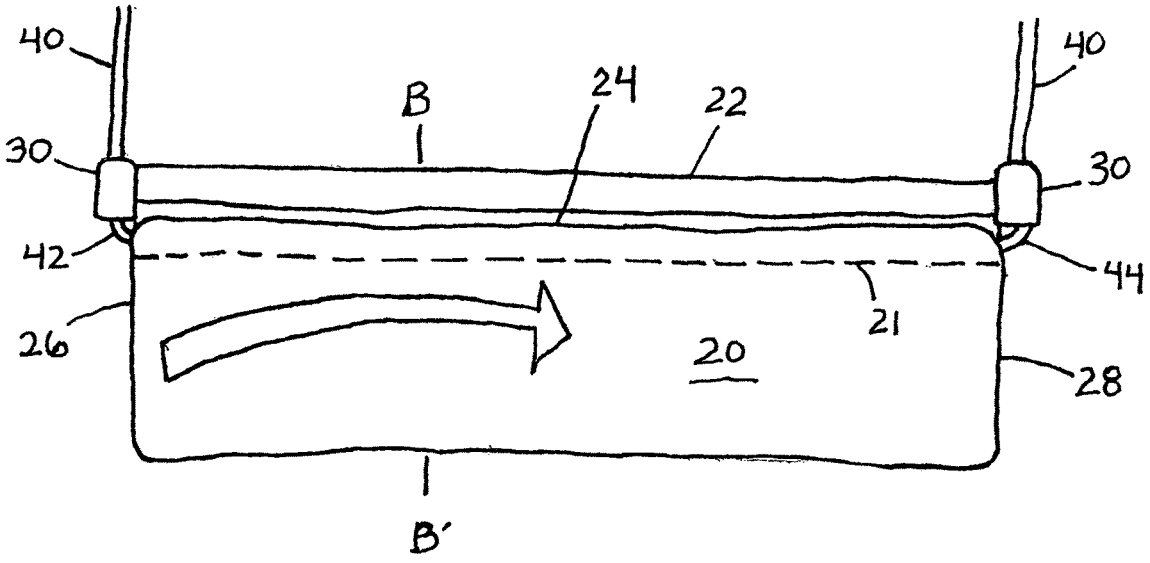

FIGS. 2A-D illustrate an exemplary method of producing a folded state of a pendent face mask as shown in FIG. 1A. In FIG. 2A, pendent face mask 10 is arranged in an extended state. Suspension system 40 is pulled upward (small arrows), while lower edge 24 is drawn upward (large arrows), such that facial cover 20 is folded across axis A-A', which extends between, and substantially parallel to, upper edge 22 and lower edge 24, until lower edge 24 approaches guides 30 on either side of facial cover 20. In FIG. 2B, left side edge 26 is folded (large arrow) across axis B-B', which extends substantially parallel to left side edge 26 and right side edge 28 at a position from left side edge 26 approximately one third of the width of facial cover 20. In FIG. 2C, partially-folded facial cover 20 is folded again (large arrow) across axis C-C', such that left side edge 26 and right side edge 28 are placed in proximity to each other, to produce a folded state of the inventive pendent face mask (FIG. 2D). As described above, the folded state, in particular embodiments, is secured in place with securing device 60.

Securing device 60 can, if desired, be decorated with attractive embroidery, buttons, sequins, colors, decals, logos, or other embellishments.

Steps 2A-E are reversed in order to open a pendent face mask according to the invention in preparation for donning the mask in a facially protective state.

Figure 3:
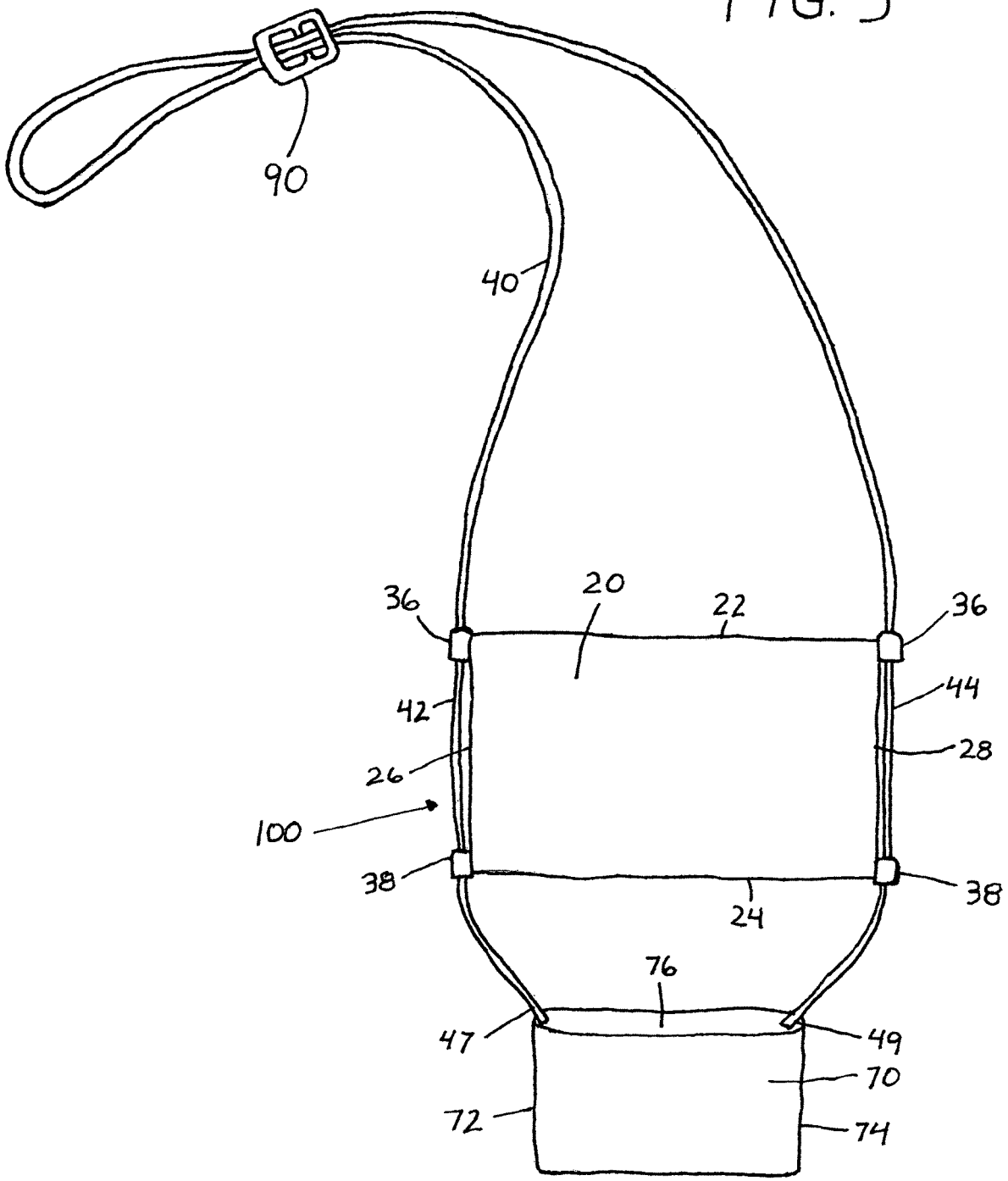
FIG. 3 is a plan view of a second embodiment of a pendent face mask according to the invention, which includes a pouch for storing the folded state of the pendent face mask.

Another specific embodiment of the inventive pendent face mask is illustrated in FIG. 3. Pendent face mask 100 includes facial cover 20 with edges 22, 24, 26, 28 as previously described. In this embodiment, first and second guides 36, 38 are secured to left side edge 26 and right side edge 28, respectively. More specifically, first guides 36 are secured adjacent upper edge 22, and second guides 38 are secured adjacent lower edge 38. Suspension system 40 is threaded through first and second guides 36, 38. As illustrated, suspension system 40 includes a cord or other flexible elongated element having first and second ends 47, 49; alternatively, two separate cords can be employed on either side. In either form, suspension system 40 further includes tightener 90 (as illustrated, a buckle). First and second ends 47, 49 are secured to pouch 70, in more specific embodiments adjacent upper ends of left side 72 and right side 74 of pouch 70, respectively. Ends 47, 49 can be permanently secured (e.g., by stitching) or releasably secured (e.g., by tying through an eyelet) to pouch 70. Pouch 70, in certain embodiments, is formed from the same fabric used to form facial cover 20; in certain other embodiments, pouch 70 is formed from a different fabric, or from a rigid material (forming a clamshell or locket structure). Pouch 70 has defined therein opening 76 sized to receive folded facial cover 20. In embodiments employing a clamshell, locket or similar structure, the structure opens sufficiently to allow folded facial cover 20 to be placed therein, and allows segments of suspension system 40 between second guides 38 and the structure to protrude.

Particular embodiments of pouch 70 range in length and width from about 4 to 5 inches.

Pouch 70, whether formed from a fabric or a rigid material, can be decorated similarly to securing device 60.

Figure 4A:
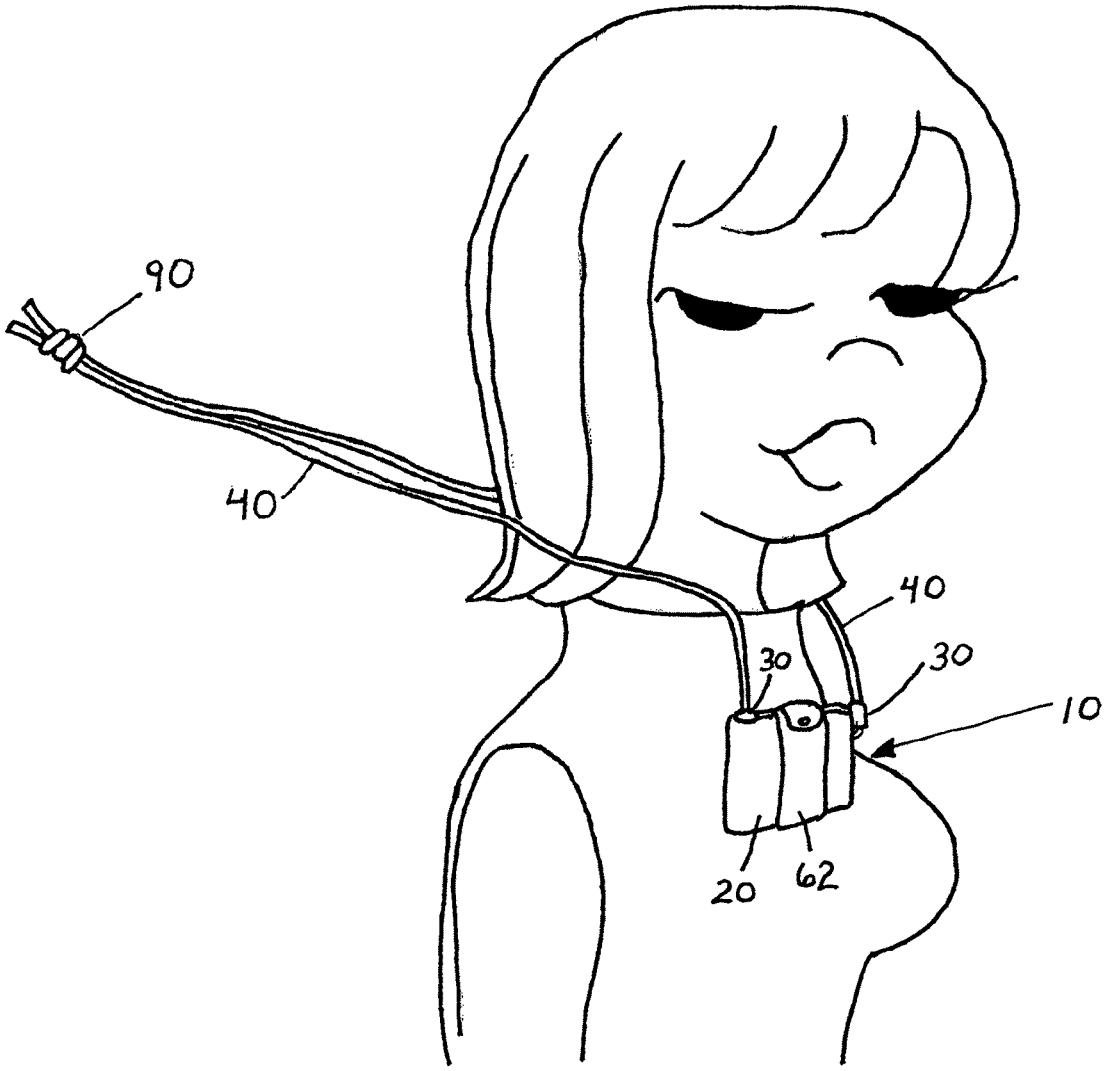
FIGS. 4A-4D depict a method of donning the pendent face mask of FIG. 1.

FIGS. 4A-D illustrate a particular method of opening a pendent face mask according to a particular embodiment of the invention and securing it in a facially protective state. In FIG. 4A, a human user places pendent facial mask 10 in a folded state around her neck, to be suspended by suspension system 40 and tightened via tightener 90. Depending on the length of suspension system 40 and the position of tightener 90, pendent facial mask 10 is positioned as a choker, necklace or pendant.

Figure 4B:
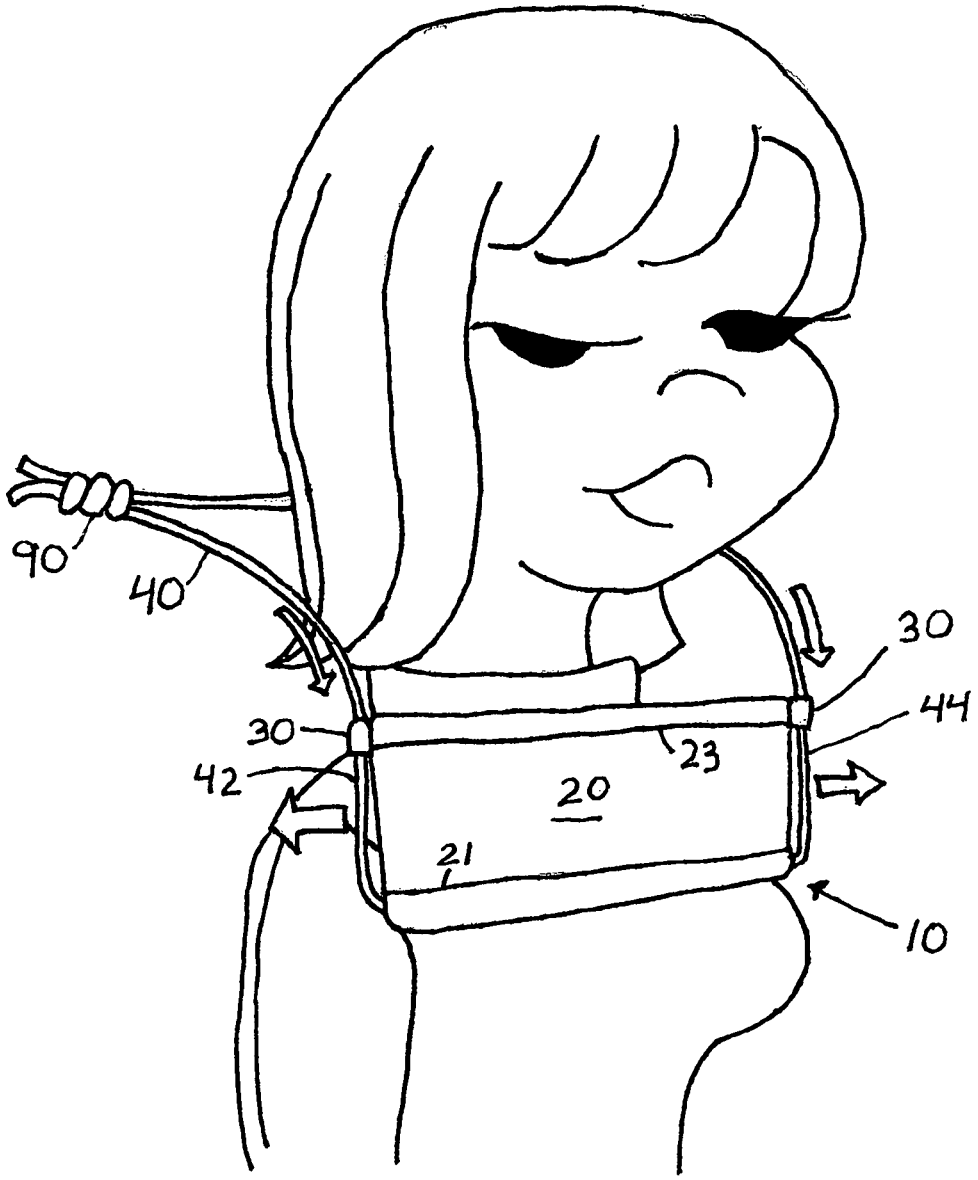

In FIG. 4B, pendent facial mask 10 is unfolded. Left and right segments 42, 44 of suspension system 40 are drawn outward from facial cover 20 (as indicated by large arrows); this pulls suspension system 40 through guides 30 (as indicated by small arrows) and forms left and right ear loops 50, 52 (see FIG. 4C).

Figure 4C:
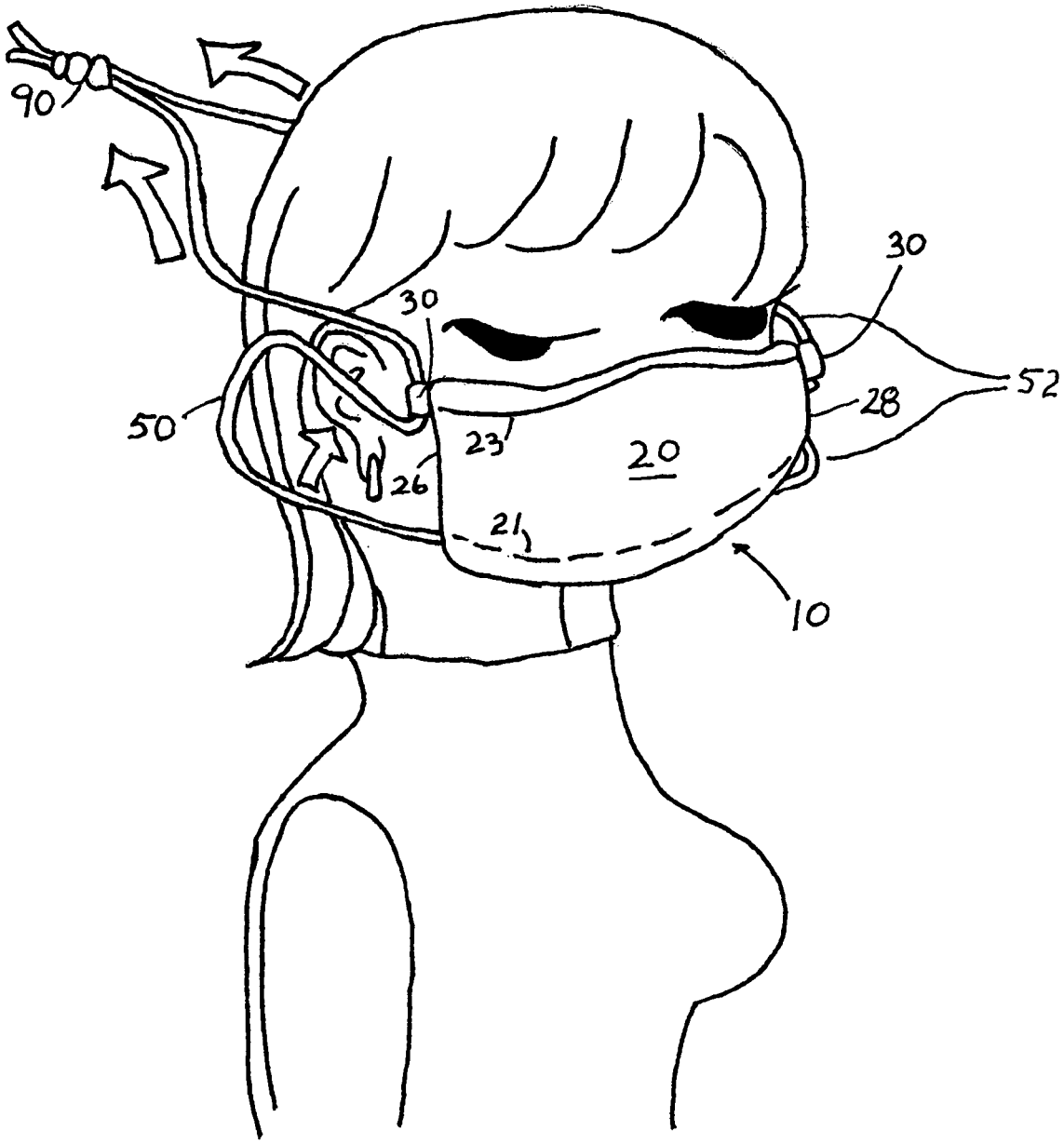
Figure 4D:
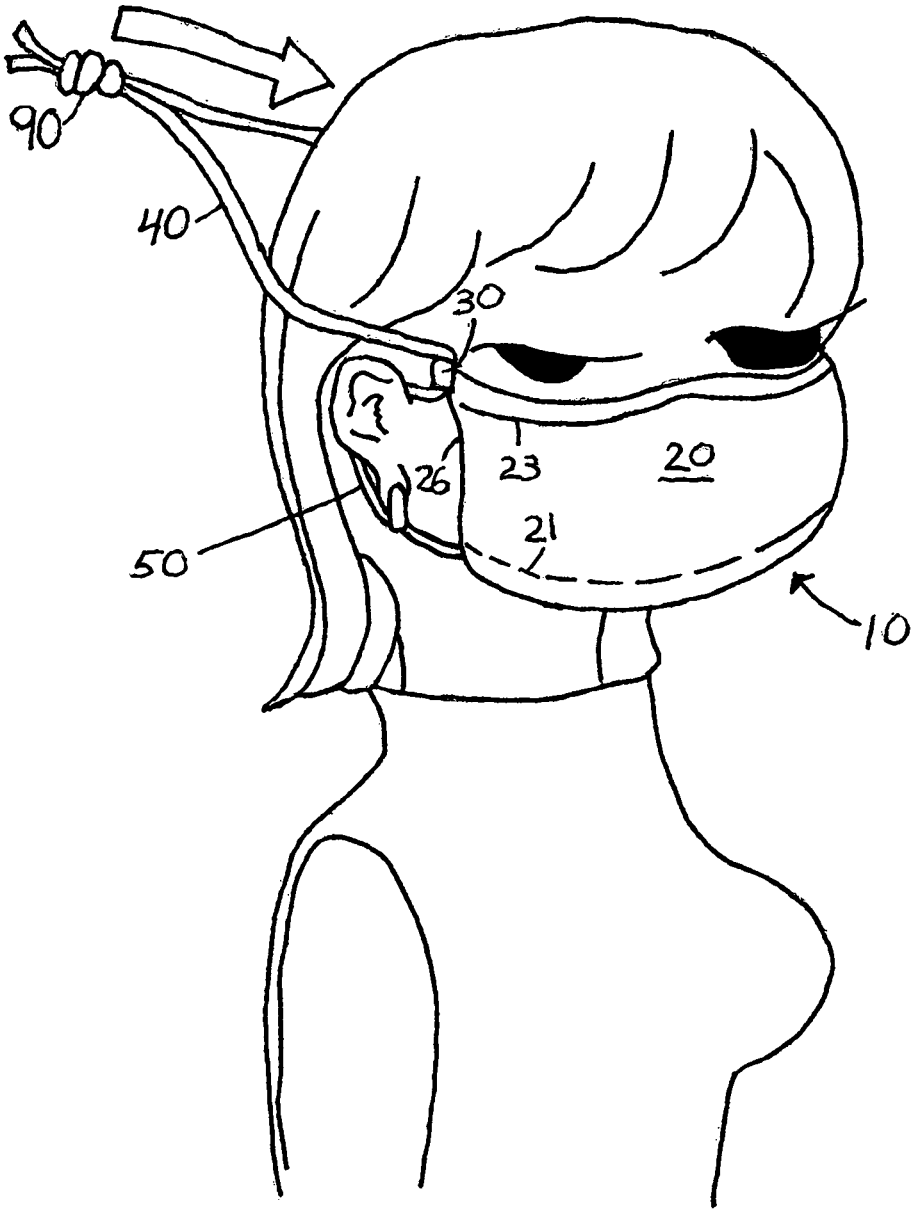

Further in FIG. 4C, facial cover 20 is disposed over the user's face, preferably covering her mouth and nose, and ear loops 50, 52 are placed over her ears (as indicated by small arrow). Suspension system 40 is drawn back behind the user's head (as indicated by large arrows), which contracts ear loops 50, 52 so that they lie tightly against her head and, together with side edges 26, 28, encircle her ears. Finally, in FIG. 4D, tightener 90 is adjusted to seat against the back of the user's head or neck, which firmly secures pendent face mask 10 in its facially protective state.

What is claimed is:

1. A pendent face mask adapted to transition between a facially protective state and a folded state, the pendent face mask comprising:

i) a facial cover comprising an air-permeable material, said facial cover comprising upper and lower edges and left and right side edges, said cover being foldable about an axis defined between said upper and lower edges and about a plurality of axes defined between said left and right side edges to form a folded state of said pendent face mask, ii) a plurality of guides, each of said guides having defined therethrough an opening, at least one said guide being secured to each of said left and right edges of said facial cover, iii) a suspension system slidingly engaged through said openings defined through each of said guides, said suspension system being adapted to suspend said facial cover in said folded state from a user's neck and to adjustably secure said facial cover in contact with said user's face in said facially protective state, said suspension system comprising left and right segments extending between said lower edge and at least one of said plurality of guides secured respectively to said left and right edges of said facial cover and being drawable to form left and right ear loops, and iv) a securing device adapted to secure said pendent face mask in said folded state.

2. The pendent face mask as claimed in claim 1, wherein said securing device comprises a protective cover.

3. The pendent ace mask as claimed in claim 2, wherein said protective cover is a strap or ribbon.

4. The pendent face mask as claimed in claim 2, wherein said protective cover comprises an edge which is attached to one of said upper and lower edge of said facial cover.

5. The pendent face mask as claimed in claim 2, wherein said protective cover is a pouch.

6. The pendent face mask as claimed in claim 1, wherein said cover further comprises a foldable nosepiece disposed adjacent said upper edge to support a facially protective state of said pendent face mask.

7. The pendent face mask as claimed in claim 1, wherein said guides are disposed adjacent said upper edge.

8. The pendent face mask as claimed in claim 7, further comprising guides adjacent said lower edge.

9. The pendent face mask as claimed in claim 1, wherein said suspension system is secured adjacent said lower edge of said facial cover.

10. The pendent face mask as claimed in claim 1, wherein said suspension system comprises a flexible elongated element selected from the group consisting of a cord, a strap, a chain and a wire.

11. The pendent face mask as claimed in claim 10, wherein said suspension system comprises a plurality of said flexible elongated elements.

12. The pendent face mask as claimed in claim 10, wherein said suspension system comprises a tightener adapted to adjustably suspend said facial cover from a user's neck in said folded state and to adjustably secure said facial cover to a user's face in said facially protective state.

13. A method of protecting a face of a human, said method comprising the steps of:

i) donning a pendent face mask adapted to transition between a facially protective state and a folded state, the pendent face mask comprising:

a) a facial cover comprising an air-permeable material, said facial cover comprising upper and lower edges and left and right side edges, said cover being foldable about an axis defined between said upper and lower edges and about a plurality of axes defined between said left and right side edges to form a folded state of said pendent face mask, b) a plurality of guides, each of said guides having defined therethrough an opening, at least one said guide being secured to each of said left and right edges of said facial cover, c) a suspension system slidingly engaged through said openings defined through each of said guides, said suspension system being adapted to suspend said facial cover in said folded state from a user's neck and to adjustably secure said facial cover in contact with said user's face in said facially protective state, said suspension system comprising left and right segments extending between said lower edge and at least one of said plurality of guides secured respectively to said left and right edgesof said-facial cover and being drawable to form left and right ear loops, and d) a securing device adapted to secure said pendent face mask in said folded state, ii) drawing said left and right segments to form left and right ear loops; and iii) disposing said left and right ear loops respectively about left and right eats of a human.

14. The method as claimed in claim 13, wherein said suspension system comprises a tightener adapted to adjustably suspend said facial cover from a users neck in said folded state and to adjustably secure said facial cover to a user's face in said facially protective state, further comprising the step of adjustably securing said facial cover to said user's face using said tightener.

15. A pendent face mask adapted to transition between a facially protective state and a folded state, the pendent face mask comprising:

i) a facial cover comprising an air-permeable material, said facial cover comprising upper and lower edges and left and right side edges, said cover being foldable about an axis defined between said upper and lower edges and about a plurality of axes defined between said left and right side edges to form a folded state of said pendent face mask, ii) first and second guides secured to each of said left and right side edges of said facial cover, each of said guides having defined therethrough an opening, and iii) a suspension system slidingly engaged through said openings defined through each of said guides, said suspension system being adapted to suspend said facial cover in said folded state from a user's neck and to adjustably secure said facial cover in contact with said user's face in said facially protective state, said suspension system comprising left and right segments, said left and right segments of said suspension system extending between said first and second guides respectively secured to said left and right edges of said facial cover, said suspension system comprising first and second ends, wherein said pendent face mask further comprises a pouch having left and right sides, said pouch being adapted to receive said pendent face mask in said folded state, said first and second ends of said suspension system being secured respectively to said left and right sides of said pouch, said left and right segments being drawable to form left and right ear loops.

* * * * *